US007654759B2

(12) United States Patent
Hsu

(10) Patent No.: US 7,654,759 B2
(45) Date of Patent: Feb. 2, 2010

(54) SAFETY MECHANISM IN AN AUTOMATIC ENGRAVING ASSEMBLY

(76) Inventor: Yung-Chieh Hsu, No. 6, Lane 97, Gaoshuang Rd., Pingjhen City, Taoyuan Hsien (TW)

( * ) Notice: Subject to any disclaimer, the term of this patent is extended or adjusted under 35 U.S.C. 154(b) by 707 days.

(21) Appl. No.: 11/467,049

(22) Filed: Aug. 24, 2006

(65) Prior Publication Data

US 2008/0050162 A1 Feb. 28, 2008

(51) Int. Cl.
*B41J 3/24* (2006.01)

(52) U.S. Cl. ..... 400/134; 408/110; 408/202; 101/38.1; 33/18.1

(58) Field of Classification Search ..... 400/134; 408/110
See application file for complete search history.

(56) References Cited

U.S. PATENT DOCUMENTS

| | | | | | |
|---|---|---|---|---|---|
| 1,705,957 | A * | 3/1929 | Braren | ..... | 409/125 |
| 2,710,549 | A * | 6/1955 | Cogsdill | ..... | 408/202 |
| 3,384,965 | A * | 5/1968 | Sicking | ..... | 33/18.1 |
| 4,507,026 | A * | 3/1985 | Lund | ..... | 408/202 |
| 5,380,132 | A * | 1/1995 | Parks | ..... | 408/202 |
| 6,543,971 | B2 * | 4/2003 | Mawhinney | ..... | 408/202 |
| 6,834,434 | B2 * | 12/2004 | Nelson | ..... | 33/18.1 |

* cited by examiner

*Primary Examiner*—Jill E Culler
(74) *Attorney, Agent, or Firm*—pattenttm.us

(57) ABSTRACT

A safety mechanism includes multiple positioning recesses defined in a bottom face of the head of the adjusting sleeve, a stop received in one of the positioning recesses, a slot defined in a top face of the body, an urging spring received in the slot, and a urging ball partially received in the slot and urged by the urging spring. Therefore, rotation of the adjusting sleeve relative to the body is limited due to engagement between the urging ball and the stop which is received in one of the positioning recesses and separation between the adjusting sleeve and the body is avoided.

2 Claims, 8 Drawing Sheets

SAFETY MECHANISM IN AN AUTOMATIC ENGRAVING ASSEMBLY

BACKGROUND OF THE INVENTION

1. Field of the Invention

The present invention relates to a safety mechanism, and more particularly to the safety mechanism in an automatic engraving assembly to prevent the adjusting sleeve from separation with the body in adjustment of the engraving knife such that the adjustment of the engraving knife is within a predetermined range.

2. Description of the Prior Art

A conventional engraving assembly (1) is shown in FIGS. 1, 2A and 2B. The engraving assembly (1) is equipped in a printer-like device so that an engraving knife which is used to replace an ink head of the printer is able to proceed with carving on a piece of paper (2) to present different patterns on the piece of paper (2). The engraving assembly (1) is movably connected to the printer-like device such that the engraving assembly (1) is able to move in a predetermined manner to carve patterns on the piece of paper (2). The extension of the engraving knife is proportional to the thickness of papers stacked on the paper tray so that the operator needs to adjust the extent of extension of the engraving knife. To accomplish the adjustment of the engraving knife, it is necessary to know the internal structure of the engraving assembly (1) as shown in FIG. 1.

The engraving assembly (1) includes a hollow cylindrical body (115) having a top opening, a bottom opening in communication with the top opening via a path inside the body (115) and a side opening (1150) to sequentially and outwardly receive therein a ball (114), a spring (113) and a side cap (112) which is threadingly inserted into the side opening (1150) of the body (115). Thus the ball (114) is abutted by the spring (113) to partially extend into the path of the body (115). An adjusting sleeve (109) has an extension (not numbered) to be inserted into the top opening of the body (115) to threadingly connect to an inner periphery of the path of the body (115) and a passage defined therein to receive a bearing (111), an adjusting spring (107) urging against the bearing (111), an abutting block (106) on top of the adjusting spring (107) to control the compression of the adjusting spring (107) and receiving therein bearing balls (105), a plate (104) and a magnet (103). A knife urging block (102) is extended into the adjusting sleeve (109) and the body (115) and a positioning bolt (101) is threadingly extended into the top opening of the adjusting sleeve (109) to securely retain the knife urging block (102), the magnet (103), the plate (104), the bearing balls (105), the abutting block (106) and the adjusting spring (107) inside the adjusting sleeve (109). One end of the engraving knife (not shown) is securely clamped by the bearing balls (105) and a portion of the engraving knife is extended through the bearing (111) so that the engraving knife is able to freely rotate while the engraving assembly (1) is activated. After the engraving assembly (1) is assembled, it is noted that an abutting cap (108) is extended into a side of the adjusting sleeve (109) to abut the knife urging block (102) to securely retain the knife urging block (102) (as well as the engraving knife) in position. Furthermore, the ball (114) in the body (115) is partially extended into the path inside the body (115) to position the knife urging block (102) to enhance the positioning effect to the knife urging block (102). In addition, the positioning sleeve (110) is threadingly connected to the adjusting sleeve (109) to prevent the adjusting sleeve (109) from movement.

While the engraving assembly is in application, the operator first has to adjust the extension of the engraving knife out of the body (115). To accomplish the objective, the operator loosens the positioning bolt (101) as well as the abutting cap (108) to allow the adjusting sleeve (109) to freely rotate. In this case, the rotation of the adjusting sleeve (109) drives the engraving knife to extend out of or retract into the body (115) in response to the thickness of the papers (2) in the paper tray.

After the adjustment is finished, the positioning sleeve (110) is again rotated to securely abut a side face of the body (115) to retain the relative position of the adjusting sleeve (109) to the body (115). To enhance the positioning effect to the knife urging block (102) inside the adjusting sleeve (109), the positioning bolt (101) is rotated and extended into the adjusting sleeve (109). Then the abutting cap (108) is extended into the adjusting sleeve (109) to abut an outer periphery of the knife urging block (102).

While the currently available engraving assembly (1) is adjusted, it is somewhat difficult for the operator to operate the adjustment in that:

The extent of extension of the engraving knife is not precisely controlled. The operator can only control the extent of extension of the engraving knife by visual estimate or other auxiliary tool to have the exact extension of the engraving knife.

The positioning bolt (101) extended into the adjusting sleeve (109) is to enhance the positioning effect to the knife urging block (102) inside the adjusting sleeve (109). However, when the adjusting sleeve (109) is rotated, the positioning bolt (101) is rotated as well because the positioning bolt (101) is threadingly connected to the adjusting sleeve (109). Therefore, the positioning effect to the knife urging block (102) is not as good as expected.

Sometimes, when the positioning bolt (101) is sunk inside the adjusting sleeve (109), the operator will have to depend on auxiliary tool to rotate the positioning bolt (101) to facilitate the adjustment of the engraving knife.

To overcome the shortcomings, the present invention tends to provide an improved safety mechanism to mitigate the aforementioned problems.

SUMMARY OF THE INVENTION

The primary objective of the present invention is to provide an improved safety mechanism in an automatic engraving assembly so as to prevent the adjusting sleeve from separation with the body in adjustment of the engraving knife such that the adjustment of the engraving knife is within a predetermined range.

In one aspect of the present invention,

In yet another aspect of the present invention,

A further aspect of the present invention is that

Other objects, advantages and novel features of the invention will become more apparent from the following detailed description when taken in conjunction with the accompanying drawings.

DETAILED DESCRIPTION OF THE PREFERRED EMBODIMENT

Figure 1:
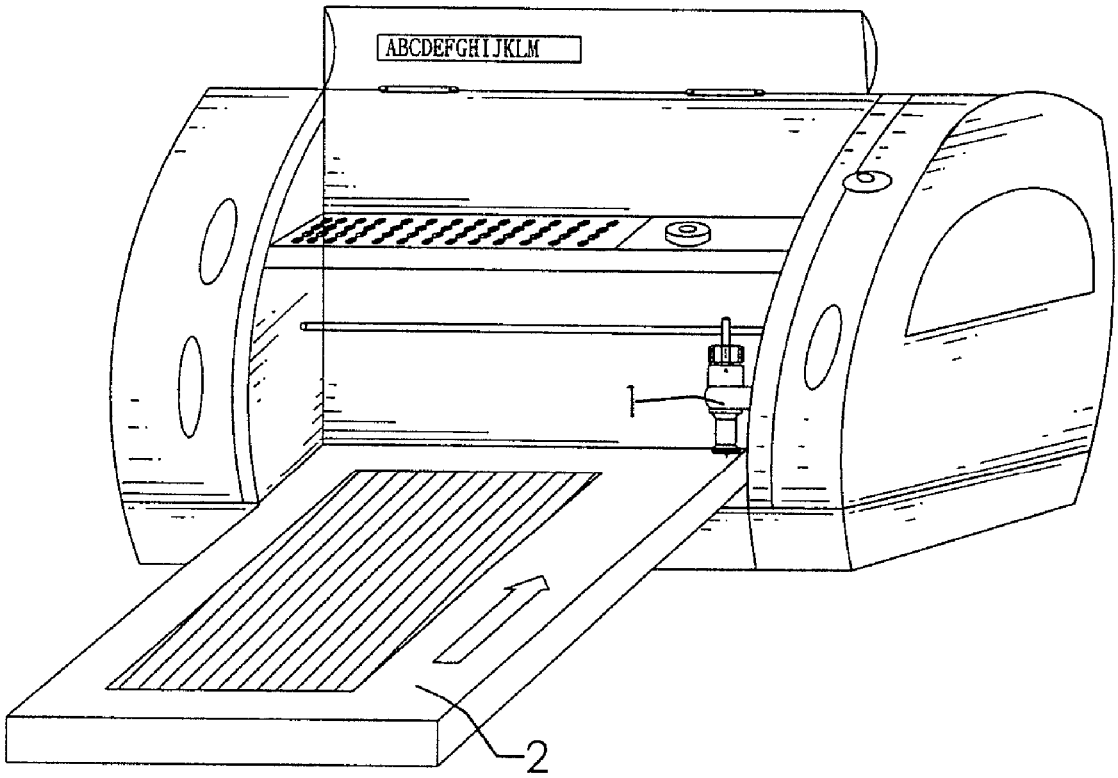
FIG. 1 is a perspective view of an automatic engraving assembly using a conventional engraving assembly.
Figure 2A:
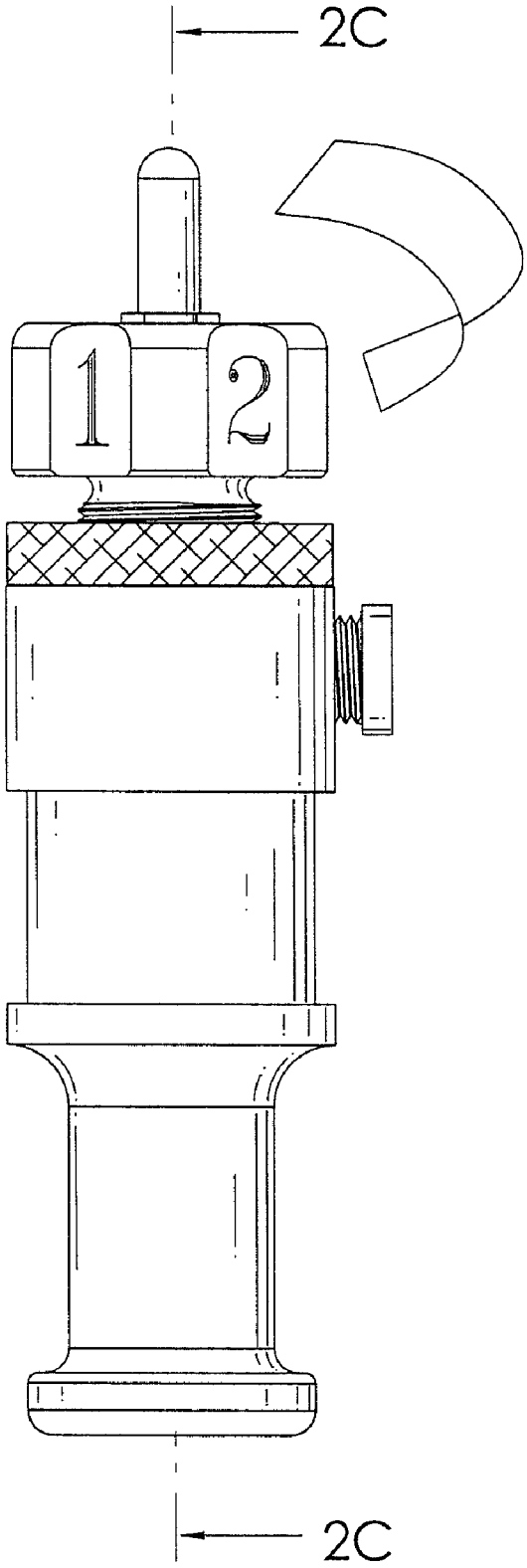
FIG. 2A is a side plan view of the conventional engraving assembly.
Figure 2B:
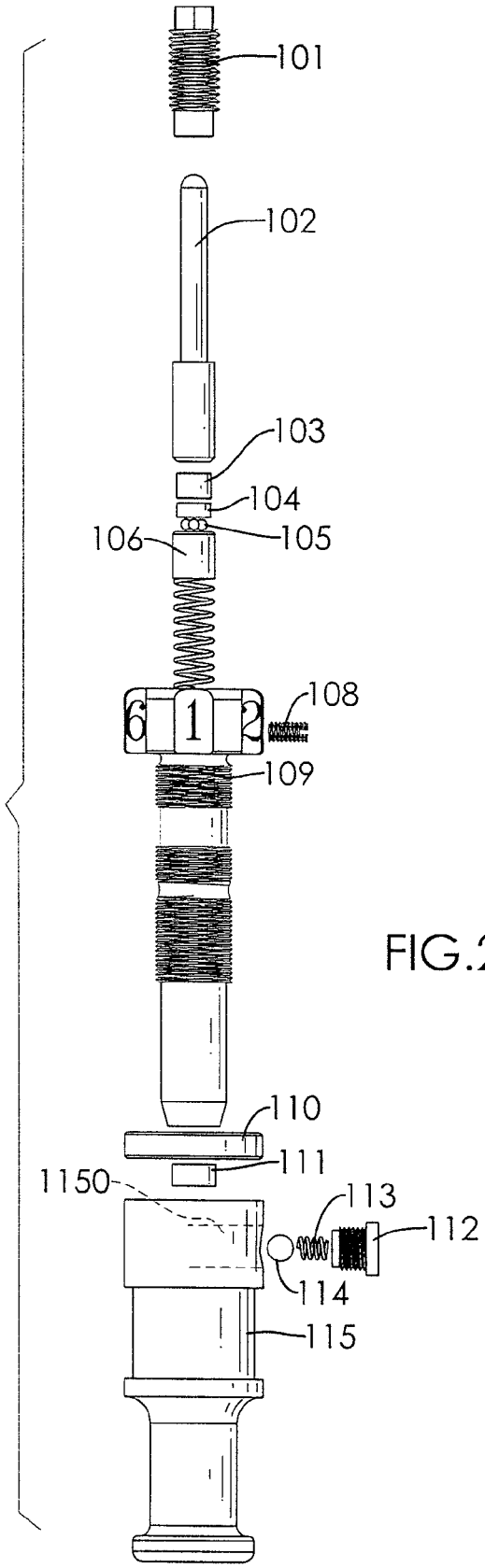
FIG. 2B is an exploded perspective view of the engraving assembly in FIG. 1.
Figure 2C:
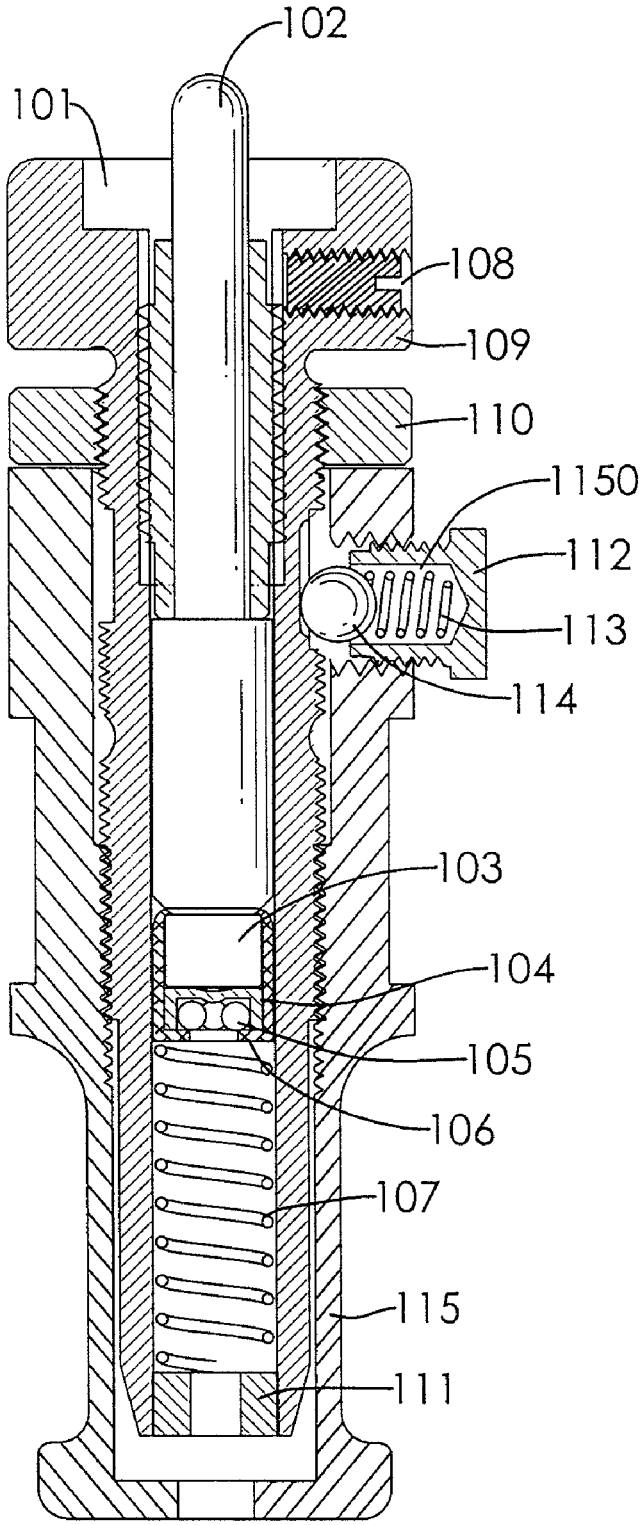
FIG. 2C is a cross sectional view taken from line 2C-2C in FIG. 1.
Figure 3A:
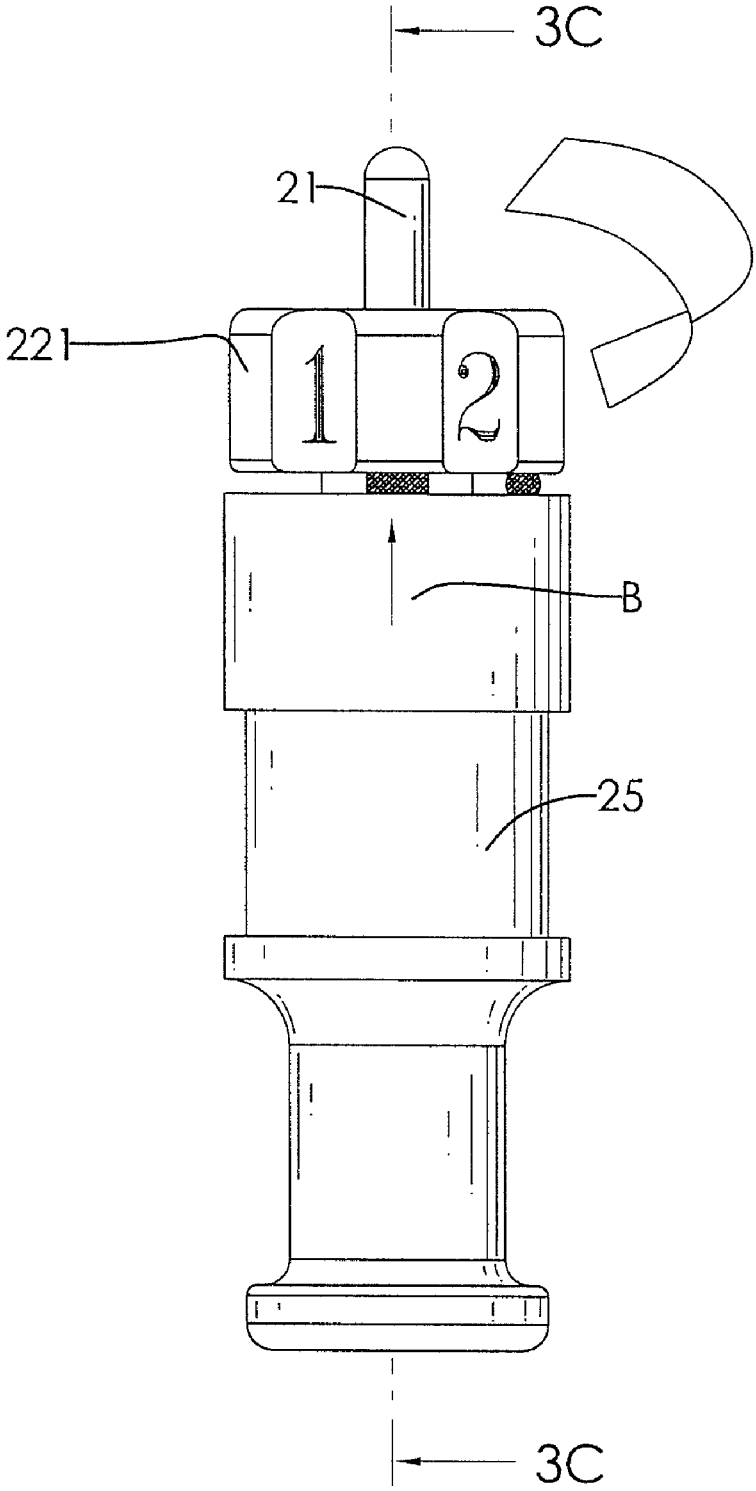
FIG. 3A is a side plan view showing the engraving assembly of the present invention.
Figure 3B:
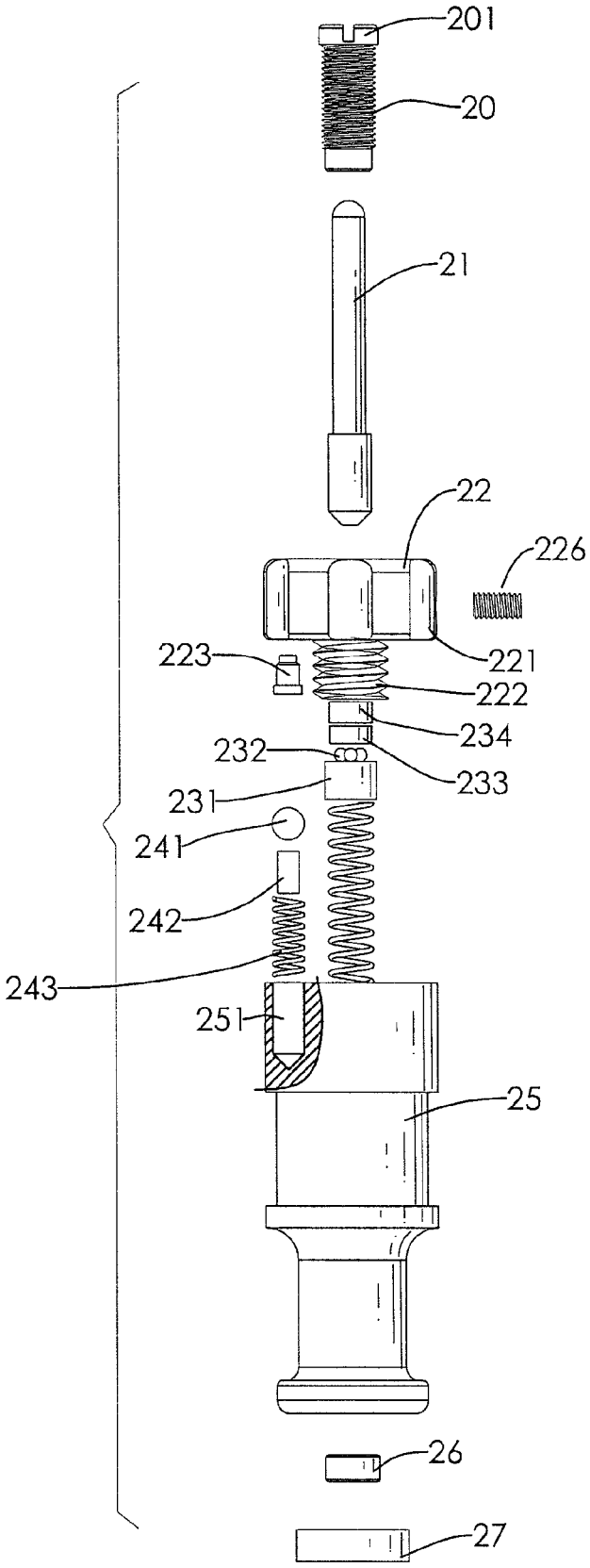
FIG. 3B is an exploded perspective view of the engraving assembly in FIG. 1.
Figure 3C:
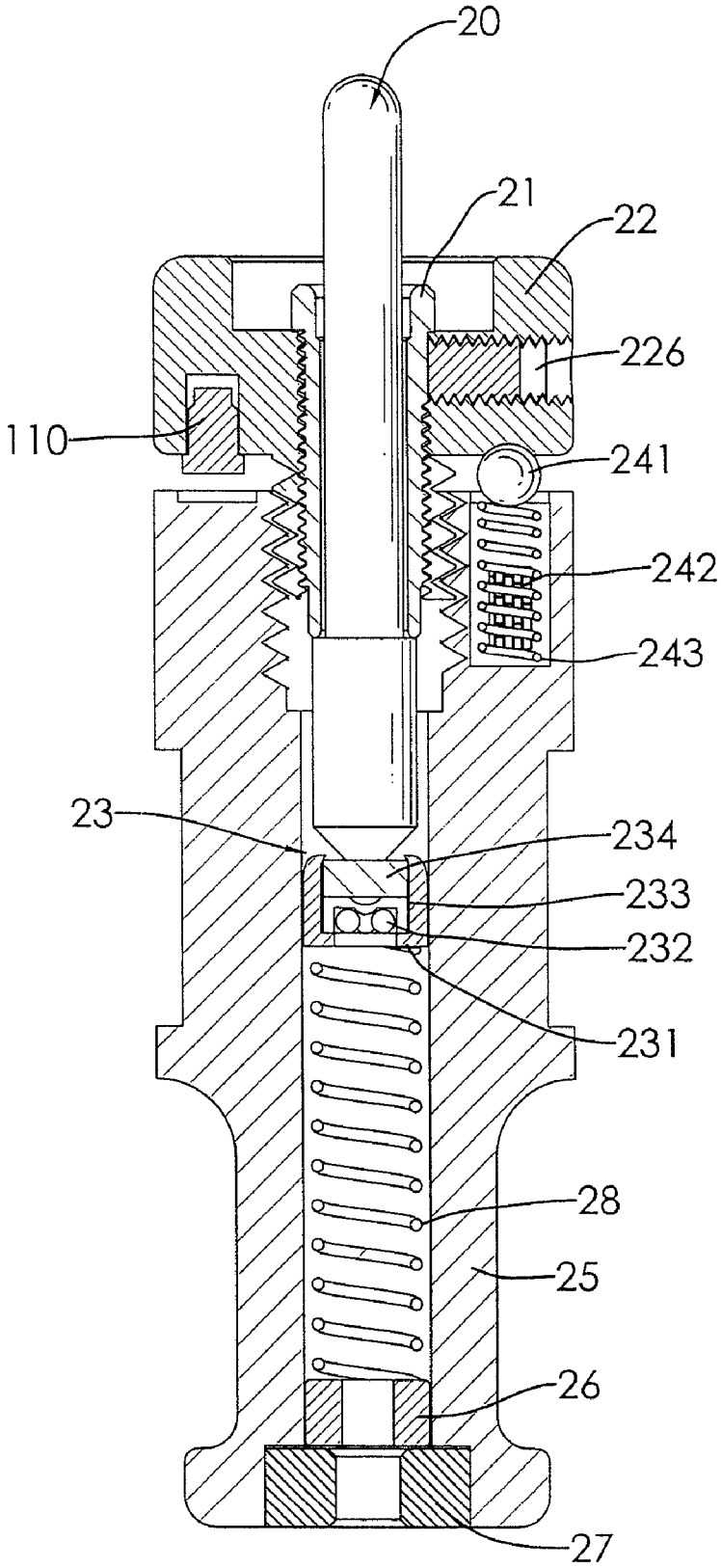
FIG. 3C is a cross sectional view taken from line 3C-3C in FIG. 3A.
Figure 3D:
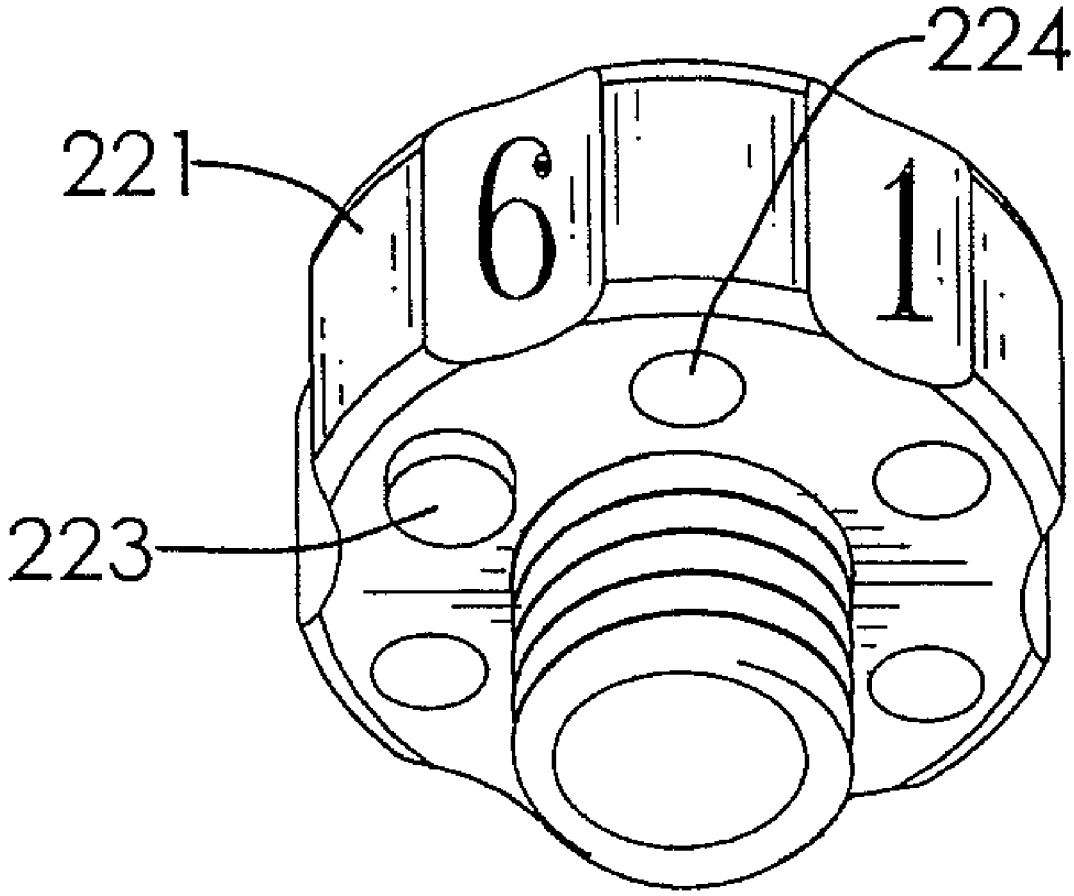
FIG. 3D is a perspective view of the upper sleeve of the present invention.

With reference to FIGS. 3A to 3D, it is noted that the engraving assembly in the automatic engraving assembly includes a body (25) having a connection hole axially defined therein, a pad (27) firmly mounted inside a bottom opening of the body (25), a bearing (26) securely connected to a top face of the pad (27) and received inside the body (25), a master spring (28) one end of which is securely abutted against a side face of the bearing (26), a sleeve (231) received inside the body (25) to abut against the other end of the master spring (28), bearing balls (232) received inside the sleeve (231) for securing one end of an engraving knife (not shown), a plate (233) positioned inside the sleeve (231) to secure the bearing balls (232), a magnet (234) also positioned inside the sleeve (231) to abut a side face of the plate (233), a knife urging bolt (21) extending into the body (25) to abut a top face of the magnet (234), an adjusting sleeve (22) having a threaded extension (222) formed with a head (221) of the adjusting sleeve (22) and threadingly extending into body (25), wherein the knife urging bolt (21) is extended through the adjusting sleeve (22), and a securing cap (20) threadingly extending into the adjusting sleeve (22) to secure the knife urging bolt (21) inside the body (25). In addition, a side cap (226) is threadingly extended into the adjusting sleeve (22) to abut an outer periphery of the securing cap (20) to prevent the securing cap (20) from rotation such that the knife urging bolt (21) is firmly secured inside the body (25) when the automatic engraving assembly is in process.

After the aforementioned components are assembled according to the above sequence inside the body (25), the operator is able to proceed macro adjustment of the engraving knife relative to the body (25). However, when proceeding with micro adjustment of the extension of the engraving knife relative to the body (25), there is provided with a safety mechanism to limit the rotation of the adjusting sleeve (22) relative to the body (25). The safety mechanism of the present invention includes multiple positioning recesses (224) defined in a bottom face of the head (221) of the adjusting sleeve (22), a stop (223) received in one of the positioning recesses (224), a slot (251) defined through a top face of the body (25), an urging spring (243) received in the slot (251), a guiding tube (242) received inside the slot (251) and having the urging spring (243) mounted therearound and a urging ball (241) partially received in the slot (251) and urged by the urging spring (243).

After the safety mechanism of the present invention is assembled, it is noted from the depiction of the accompanying drawings that when the urging ball (241) is right below the stop (223), the extent of extension of the engraving knife is set to be zero (0 extension). Rotation of the adjusting sleeve (22) in either directions allows the urging ball (241) to be selectively received in a corresponding one of the positioning recesses (224). No matter how much the adjusting sleeve (22) is rotated, eventually the urging ball (241) engages with the stop (223), which limits further rotation of the adjusting sleeve (22). Accordingly the adjusting sleeve (22) is always kept in contact with the body (25).

Further, everytime the urging ball (241) falls into the corresponding positioning recess (224), a clicking sound is generated to inform the operator how much the adjusting sleeve (22) is rotated, which also performs a positioning effect to the adjusting sleeve (22) to the body (25).

In addition, the mutual cooperation between the pitch of each threading of the adjusting sleeve (22) and the distance between two adjacent positioning recesses (224) provides precise extension of the engraving knife out of the body (25). For example, if the pitch is set to be 1.15 mm, movement of the urging ball (241) from one positioning recess (224) to the adjacent positioning recess (224) provides 0.2 mm extension of the engraving knife. Therefore, if there are five positioning recesses (224), rotation of the adjusting sleeve (22) from the first positioning recess (224) to the fifth positioning recess (224), there will be 1 mm extension of the engraving knife.

In order to facilitate understanding of how much the engraving knife is extended out of the body (25), first marks (A) of different patterns and a second mark (B) are formed on an outer periphery of the adjusting sleeve (22) and the body (25) to indicate the degree of adjustment.

Meanwhile, the adjusting sleeve (22) is provided with a recessed area (225) defined in a top face thereof to receive therein the securing cap (20) having an enlarged head (201) formed on top of the securing cap (20) so that the securing cap (20) is kept on a position where the operator can always have access to operate the securing cap (20).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an automatic engraving assembly having a body having a connection hole axially defined therein, a pad firmly mounted inside a bottom opening of the body, a bearing securely connected to a top face of the pad and received inside the body, a master spring, one end of which is securely abutted against a side face of the bearing, a sleeve received inside the body to abut against the other end of the master spring, bearing balls received inside the sleeve for securing one end of an engraving knife, a plate positioned inside the sleeve to secure the bearing balls, a magnet also positioned inside the sleeve to abut a side face of the plate, a knife urging bolt extending into the body to abut a top face of the magnet, an adjusting sleeve having a threaded extension formed with a head of the adjusting sleeve and threadingly extending into body, wherein the knife urging bolt is extended through the adjusting sleeve, and a securing cap threadingly extending into the adjusting sleeve to secure the knife urging bolt inside the body, wherein the improvement comprises: multiple positioning recesses defined in a bottom face of the head of the adjusting sleeve, a stop received in one of the positioning recesses, a slot defined in a top face of the body, an urging spring received in the slot, and a urging ball partially received in the slot and urged by the urging spring such that rotation of the adjusting sleeve relative to the body is limited due to engagement between the urging ball and the stop which is received in one of the positioning recesses and separation between the adjusting sleeve and the body is avoided.

2. The automatic engraving assembly as claimed in claim 1 further comprising a guiding tube received in the slot of the body and having the urging spring mounted therearound so as to guide movement of the urging spring.

* * * * *